US005266354A

United States Patent [19]

Tohyama et al.

[11] Patent Number: 5,266,354

[45] Date of Patent: Nov. 30, 1993

[54] COATED FABRIC OF A POLYESTER FIBER AND A METHOD FOR PREPARATION THEREOF

[75] Inventors: Syunroku Tohyama, Shiga; Masami Ikeyama, Yokkaichi; Ikuko Nakabe, Ibaraki, all of Japan

[73] Assignee: Toray Industries, Inc., Tokyo, Japan

[21] Appl. No.: 915,620

[22] Filed: Jul. 21, 1992

Related U.S. Application Data

[62] Division of Ser. No. 560,623, Jul. 31, 1990, Pat. No. 5,154,966.

[51] Int. Cl.[5] ..... B05D 1/36

[52] U.S. Cl. ..... 427/203; 427/204; 427/205; 427/142.5

[58] Field of Search ..... 427/389.9, 203, 204, 427/205, 412.5

[56] References Cited

U.S. PATENT DOCUMENTS 4,732,805 3/1988 Maggs ..... 428/240
5,154,966 10/1992 Tohgama et al. ..... 428/283 X

FOREIGN PATENT DOCUMENTS 58-4873 1/1983 Japan .
60-45680 3/1985 Japan .
62-53632 11/1987 Japan .

OTHER PUBLICATIONS

Derwent Abstract of JP 58004873.
Derwent Abstract of JP 60045680.
Derwent Abstract of JP 87053632.

*Primary Examiner*—Michael Lusignan
*Attorney, Agent, or Firm*—Armstrong, Westerman, Hattori, McLeland & Naughton

[57] ABSTRACT

The present invention relates to a coated fabric of a polyester fiber exhibiting no staining caused by migration of a dispersed dye and a method for preparation thereof. The present invention catches a dye migrating in a resin by using fine inorganic particles having dye-absorption capabilities to confine dye molecules in fine pores thereof, and to prevent the surface of another fabric from staining due to dye-migration.

4 Claims, 1 Drawing Sheet

COATED FABRIC OF A POLYESTER FIBER AND A METHOD FOR PREPARATION THEREOF

This is a division of application Ser. No. 560,623 filed Jul. 31, 1990, now U.S. Pat. No. 5,154,966.

BACKGROUND OF THE INVENTION

1. Field of the Invention

The present invention generally relates to a coated fabric of a polyester fiber which does not exhibit any staining due to dye migration and a method for preparation thereof.

2. Description of the Relevant Art

As coated fabrics are widely used nowadays, woven and knitted fabrics have nylon fibers as the main components and are, for example, treated with such treatments as repellent and waterproof, water-vapor permeable and repellent, breathable, flame-proof and melt-proof coatings.

Recently, however, differences in prices between nylon fibers and polyester fibers have remarkably increased that development on coating treatments of polyester fibers are being actively carried out. Polyester fibers have such superior characteristics as in dimensional stability, strength, light resistance and diversity of the raw material as compared to nylon fibers.

However, the coated fabrics of polyester fiber have such a fatal defect that the dye in the polyester fiber migrates to the coated film so that the coated film of the product having the base fabric of which is dyed and the other coated film which is brought into contact therewith through the film faces thereof are stained. In other words, in the case of dyeing the polyester fiber with a dispersed dye, polyester fiber does not combine chemically with the dye, for example, in contrast with the dyeing of nylon with an acid dye and in addition, the dispersed dye has good solubility in and affinity with organic solvents and synthetic resins so that the dye molecules in the fiber could easily migrate to the coated film layer.

Therefore, when coated faces of different colors are brought into contact with each other, staining consequently occurs. Various investigations have taken place in order to solve this problem, but no satisfactory or perfect solution has yet been found, and thus, a dyed product of the coated fabric of a polyester fiber has not been put to practical use.

So far, in both Japanese Patent Laid-Open Publication No. 4873/1983, and Japanese Patent Publication No. 53632/1987, methods which have quite different purposes from that of the present invention have been proposed. It is proposed in these publications that fiber structures are to be treated by providing a water repellant having a perfluoroalkyl group to a fiber structure on which a polyurethane resin film containing porous particles wherein $SiO_2$ was the main component.

However, the methods disclosed in the publications attempt to obtain a waterproof fabric exhibiting both breathable and water-vapor permeable characteristics by making fine pores of particles incorporated in a polyurethane resin for paths for air and water-vapor, but no suggestion is made on a coating film which can prevent staining caused by a dispersed dye.

SUMMARY OF THE INVENTION

The present invention relates to a coated fabric of a polyester fiber wherein a dispersed dye is caught with porous inorganic particles having fine pores of a specified pore diameter, whereby migration and staining of dye from a fabric face to another fabric face are minimized, and to a method for preparation thereof.

These and other features of the invention will be understood upon reading of the following description along with the drawings.

DETAILED DESCRIPTION OF THE PREFERRED EMBODIMENTS

Figure 1:
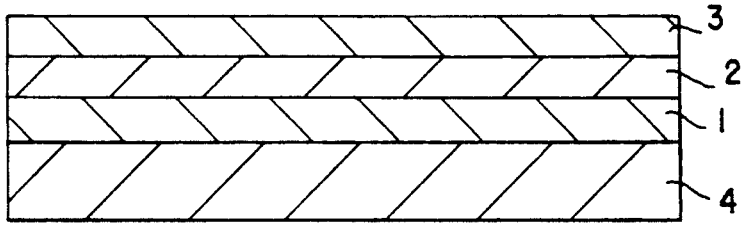
FIG. 1 is a cross-sectional view of a coated fabric of a polyester fiber obtained in Example 4 of the present invention showing first, second and third layers, and a fiber layer.

The polyester fiber structure of the present invention means not only woven and knitted fabrics and non-woven fabrics of 100% polyester fiber, but also mixed spun, combined filament, different yarns-twisted union-woven and union-knitted fabrics, wherein polyester fibers are essential components and no limitation exists, but the effect is more remarkable when 100% polyester or the polyester fiber with a high rate of blend, each being dyed with a dispersed dye is used.

Porous inorganic particles are used in the present invention, such as, silicon dioxide, titanium oxide, zirconium oxide, aluminum oxide, active carbon. Among these porous inorganic particles, silicon dioxide is most effective in terms of effect and utility.

The dimension of the fine pore diameter in the porous inorganic particles largely influences the absorption effect of the migrated dye. Therefore, the one with a fine pore diameter of 150Å or smaller can be used. A diameter of 10–100 Å is preferable in terms of the effect. If it is larger than 150 Å, absorption and retention of the migrated dye is not sufficient.

In addition, the surface area of the porous inorganic particle is preferably 200 $m^2/g$ or larger, but preferably, 500 $m^2/g$. If the surface area is smaller than 200 $m^2/g$, the effect of the present invention is not sufficient.

As the resin material used in the present invention, various resins used for ordinary coating treatments, such as, polyurethane, acrylic, silicones, polyvinyl chloride and polyvinyl acetate can be freely selected.

Next, a method for preparation of a coated fabric in the present invention will be described.

There are two methods hereinafter described. The first one is a method wherein porous inorganic particles are adhered on the fiber surface before coating, and the second one is a method wherein the porous inorganic particles are incorporated in a film of a coating resin.

The first method (i.e., a method wherein porous fine inorganic particles are adhered on the surface of the fiber before coating) is now explained. In the first method, it is essential to make the porous fine inorganic particles adhered on the surface of the fiber uniform to fully exhibit the effect of the present invention. In terms of handling and workability, it is a preferable method that an ag. dispersion of the porous fine inorganic particles is adhered by means of padding. The drying temperature after padding should be at 80° C.–160° C., preferably in the range of 100° C.–130° C., and with the drying temperature above 160° C., the effect decreases. As to the amount of adhered porous fine inorganic particles, 0.5–15 wt. % is preferably based on the weight of the fabric, and 1.5–10 wt. % is more preferable.

As to the particle size of the porous fine inorganic particles to be used, the particles in the range of 1-100 nm can be used, and particles in the range of 10-50 nm are usually and preferably used.

In order to improve durability of the porous fine inorganic particles adhered on the surface of the fiber, a method for using an ordinary resin for finishing in parallel is preferably used.

The second method for preparing a coated fabric in this invention is a method which disperses in advance porous fine inorganic particles in a resin for coating, and the particle size to be used is 15 μm at a maximum, although a lesser particle size is preferred. In this method, good dispersion of the porous fine inorganic particle in the resin is important. Agglomeration of particles causes a decrease in the effect of staining prevention and deterioration of coating quality.

In the second method, there exists a method wherein porous fine inorganic particles are lamellarly distributed in the resin film. For example, as illustrated in FIG. 1, a lamellar structure having a resin layer A wherein porous fine inorganic particles are lamellarly dispersed at a high concentration, and a resin layer B wherein the porous fine inorganic particles are small or are not incorporated is provided.

Practically speaking, a resin solution A containing 10% or more inorganic particles based on the weight of the solid content of the resin as a resin layer containing inorganic particles with a high concentration, and a resin solution B containing not less than 10% inorganic particles as a resin layer are prepared. As the order of coating, either a method wherein the first layer 1 of the fiber layer 4 is prepared by coating with the resin solution B, and the second layer 2 is prepared by coating with the resin solution A or a method where the procedure is done in the reverse order can be used. In addition, in order to prepare a triple layered structure by coating, either the first, second or third layer, as shown in FIG. 1, is coated with the resin solution A and the other two layers are coated with the resin solution B. In the case where the first layer 1 is coated with the resin solution A for coating the double structure or triple structure, adhesiveness with the fiber decreases in some cases. If the adhesiveness with the fiber is especially required, it is preferable that the second layer 2 or the third layer 3 is coated with the resin solution A. In addition, it is preferable that the thickness of the resin layer A wherein porous fine inorganic particles are lamellarly dispersed at a high concentration is 3 μm or thicker. No limitation exists on the coating method. In the method wherein porous fine inorganic particles with a high concentration are lamellarly incorporated in a resin for coating, as the porous fine inorganic particles with a high concentration catch completely dye molecules migrating from a fiber into a resin film and the dye molecules are absorbed and kept in the fine pores which the porous fine inorganic particles have, the present invention thereby exhibits an effect for preventing permanent dye from migrating.

The present invention is now described in more detail with the following Examples. It is noted that the present invention is not limited to the Examples hereinafter described.

Firstly, an evaluation on the quickness on how dye migration and staining occurs in the Examples was performed by means of the following method.

A test piece (5 cm×5 cm), and attached white polyester fabrics (i.e., the raw fabric of which was the same as the test piece and which were coated with the same resin as the one used for the test piece; 5 cm×5 cm) were inserted between two glass plates in such a way that the coated faces of the attached white polyester fabrics were brought into contact with both the coated face and the non-coated face of the test piece, and were placed in a constant temperature oven (at 100° C.±2° C.) for 48 hours, while a load of 200 g was applied thereon. After cooling, the state of dye migration from the test piece to the attached white fabric was evaluated in terms of a classification by means of a grey scale for staining evaluation.

The results obtained in the Examples and Comparative Examples are summarized in Table 1.

Secondly, the following resins were used as coating resins in the Examples and Comparative Examples:

Polyether polyurethane resin ("CRISBON 8006HV" manufactured by Dainippon Ink Chemical Co., Ltd.)

Acrylic resin ("CRISCOAT P-1120" manufactured by Dainippon Ink Chemical Co., Ltd.); and Silicone resin (Toray silicone "SD 8001" manufactured by Toray Silicone Co., Ltd.).

EXAMPLE 1

A plain woven fabric prepared by using polyester filaments of each 50 denier as a warp and 75 denier as a weft was dyed with a dispersed dye with "Resoline Blue FBL" of 3% o.w.f. at 130° C. for 60 min. and was washed in a usual manner. A dyed fabric for coating was obtained by performing heat-setting treatment at 180° C. after drying.

Then, padding of this fabric was performed with an aqueous solution wherein 30 g/l of a trimethylolmelamine and a silicon dioxide with a particle diameter of 20 nm, a fine pore diameter of 60 Å and a surface area of 300 $m^2/g$ which is 15% of the solid content of the resin were dispersed and the fabric was dried at 130° C. for 1 min. The build-up of the silicon dioxide was 2.4%. Then, the fabric was coated with a polyether polyurethane resin solution in dimethylformamide by means of a knife coater and the solution was coagulated by means of a wet process to obtain a coated fabric with a coating weight of 25 $g/m^2$.

COMPARATIVE EXAMPLE 1

The dyed fabric obtained in Example 1 was wet-coated only with a polyether polyurethane resin solution in dimethylformamide without treating it with silicon dioxide.

EXAMPLE 2

A dyed fabric for coating was obtained by the same method as that of Example 1. Then, 15% of a silicon dioxide based on the solid content of the resin with a particle diameter of 3 μm, a fine pore diameter of 50 Å and a surface area of 500 $m^2/g$ were dispersed in a polyether polyurethane resin solution in dimethylformamide and the fabric was coated with this solution by means of a knife coater to obtain a coated fabric.

COMPARATIVE EXAMPLE 2

A coated fabric using a silicon dioxide with a particle diameter of 20 μm, a fine pore diameter of 210 Å and a surface area of 150 $m^2/g$ was obtained by the same method as that of Example 2.

EXAMPLE 3

A coated fabric was obtained by the same method as that of Example 2, except an acrylic and a silicone resin as the coating resin was used.

COMPARATIVE EXAMPLE 3

A coated fabric was obtained by the same method as that of Example 3, except separately using an acrylic resin and a silicone resin without silicon dioxide.

EXAMPLE 4

A dyed fabric for coating was obtained by the same method as the one in Example 1.

Then, it was coated with a polyether polyurethane resin solution in dimethylformamide as a coating resin by means of a knife coater and the coated resin solution was coagulated by means of a wet process to obtain a film.

Thirty percent (30%) of silicon dioxide based on the solid content of the resin with an inorganic particle diameter of 3 μm, a fine pore diameter of 50 Å and surface area of 500 $m^2/g$ were dispersed in the same resin solution and the obtained coated fabric was coated with this solution by means of a knife coater and the coated solution was coagulated by means of a wet process to make a top coat of a film. Furthermore, this coated fabric was coated with the same resin containing no porous fine inorganic particle by means of a knife coater and the coated resin solution was coagulated by means of a wet process to obtain a coated fabric of a triple layered structure, wherein an intermediate inorganic particle layer existed. The thickness of the porous fine inorganic particle layer was 10 μm.

EXAMPLE 5

A coated fabric was obtained by the same method as the one in Example 1, except using acrylic and silicon resins as the coating resins. The thickness of the layer of porous fine inorganic particles was 10 μm.

COMPARATIVE EXAMPLE 4

A dyed fabric for coating was obtained by the same method as the one in Example 1. Then, 15% of silicon dioxide with a particle diameter of 3 μm, a pore volume of 0.5 cc/g, a pore diameter of 170 Å and a surface area of 300 $m^2/g$ based on the solid content of the resin were dispersed in a polyester polyurethane resin solution in dimethylformamide, and the fabric was coated with the obtained solution by means of a knife coated to obtain a coated fabric.

TABLE 1

| | Condition | | Fastness to migration and staining |
|---|---|---|---|
| | Silicon dioxide | Resin | |
| Example 1 | 20 nm | Urethane | 4–5 |
| Comparative Example 1 | — | Urethane | 2 |
| Example 2 | 3 μm, 50Å 500 $m^2/g$ | Urethane | 4–5 |

TABLE 1-continued

| | Condition | | Fastness to migration and staining |
|---|---|---|---|
| | Silicon dioxide | Resin | |
| | 500 $m^2/g$ | | |
| Comparative Example 2 | 20 μm, 210Å 150 $m^2/g$ | Urethane | 2 |
| Example 3 | 3 μm, 50Å 500 $m^2/g$ | Acrylic | 4–5 |
| | 3 μm, 50Å 500 $m^2/g$ | Silicon | 4–5 |
| Comparative Example 3 | — | Acrylic | 1 |
| | — | Silicon | 1 |
| Example 4 | 3 μm, 50Å 500 $m^2/g$ | Urethane | 5 |
| Example 5 | 3 μm, 50Å 500 $m^2/g$ | Acrylic | 4–5 |
| | 3 μm, 50Å 500 $m^2/g$ | Silicon | 4–5 |
| Comparative Example 4 | 3 μm, 170Å 300 $m^2/g$ | Urethane | 2–3 |
| | | Silicon | 1 |

Note: The column of silicon dioxide shows the average particle diameter, the average particle pore diameter, and the surface area from the top.

The coated fabric of the present invention can be widely used for clothing and for industrial uses as various products treated with such treatments as repellent and waterproof, water-vapor permeable and repellent, breathable, flameproof and melt-proof coatings.

The coated fabric of the present invention especially supplements the defects of the coated fabrics of nylon fibers in terms of dimensional stability, light resistance, price, and versatility of raw materials and substituted for a part of its demand.

While the invention has been particularly shown and described in reference to preferred embodiments thereof, it will be understood by those skilled in the art that changes in form and details may be made therein without departing from the spirit and scope of the invention.

What is claimed is:

1. A method for preparing a coated fabric of a polyester fiber, comprising the steps of:

adhering to the surface of a fabric of a polyester fiber porous fine inorganic particles having fine pores with an average pore diameter of not greater than 150 Å, wherein said porous fine inorganic particles are fine particles each with a surface area of at least 200 $m^2/g$; and performing a coating treatment on said surface.

2. A method for preparing a coated fabric of a polyester fiber according to claim 1, wherein said porous fine inorganic particle has an average particle diameter of 10–50 nm.

3. A method for preparing a coated fabric of a polyester fiber, comprising the step of coating a fabric with a resin solution containing an effective stain preventing amount of porous fine inorganic particles having fine pores with an average pore diameter of not greater than 150 Å, wherein said porous fine inorganic particles are fine particles each with a surface area of at least 200 $m^2/g$ resulting in preventing staining of a dispersed dye from said fabric.

4. A method for preparing a coated fabric of a polyester fiber according to claim 3, wherein said porous fine inorganic particle has an average particle diameter of not greater than 15 μm.

* * * * *